United States Patent [19]

Schultes et al.

[11] 4,077,421

[45] Mar. 7, 1978

[54] SHORTENABLE UMBRELLA

[75] Inventors: Tilmann Schultes; Joachim Seidel, both of Solingen, Germany

[73] Assignee: Kortenbach & Rauh Kommanditgesellschaft, Solingen, Germany

[21] Appl. No.: 784,976

[22] Filed: Apr. 6, 1977

[30] Foreign Application Priority Data

Apr. 10, 1976 Germany ..... 2615732

[51] Int. Cl.[2] ..... A45B 19/04

[52] U.S. Cl. ..... 135/25 R; 135/26; 135/27

[58] Field of Search ..... 135/25 R, 25 A, 26, 135/27

[56] References Cited

U.S. PATENT DOCUMENTS

| | | | |
|---|---|---|---|
| 1,249,007 | 12/1917 | Block | 135/25 R |
| 2,649,103 | 8/1953 | Militano | 135/25 R |
| 3,902,514 | 9/1975 | Weber | 135/25 R |
| 4,007,752 | 2/1977 | Weber | 135/25 R |
| 4,030,514 | 6/1977 | Schultes | 135/25 A X |
| 4,030,515 | 6/1977 | Weber | 135/26 |

*Primary Examiner*—Werner H. Schroeder
*Assistant Examiner*—Conrad L. Berman
*Attorney, Agent, or Firm*—Martin A. Farber

[57] ABSTRACT

A shortenable umbrella with frame or blade parts carrying the umbrella canopy in opened condition, the frame parts being shortenable at least by a factor of two by telescoping or folding, of which the innermost parts are pivoted on a crown secured on a shortenable rod assembly and are horizontally pivotable by means of at least one slider by means of at least one set of forks, whereby each outermost blade part is hinged foldable on the adjacent blade part by means of a control rod which acts on an extension of each outermost blade part. A control piece is formed as a slide hinge which is displaceably guided on the fork, the slide hinge being articulated on the middle hinge by means of a connection portion spaced from the articulation point of the fork. The inner end of the control rod is articulated pivotally on the control piece, the movement of the fork actuating the control piece.

5 Claims, 6 Drawing Figures

Fig. 2

SHORTENABLE UMBRELLA

Figures 1, 2:
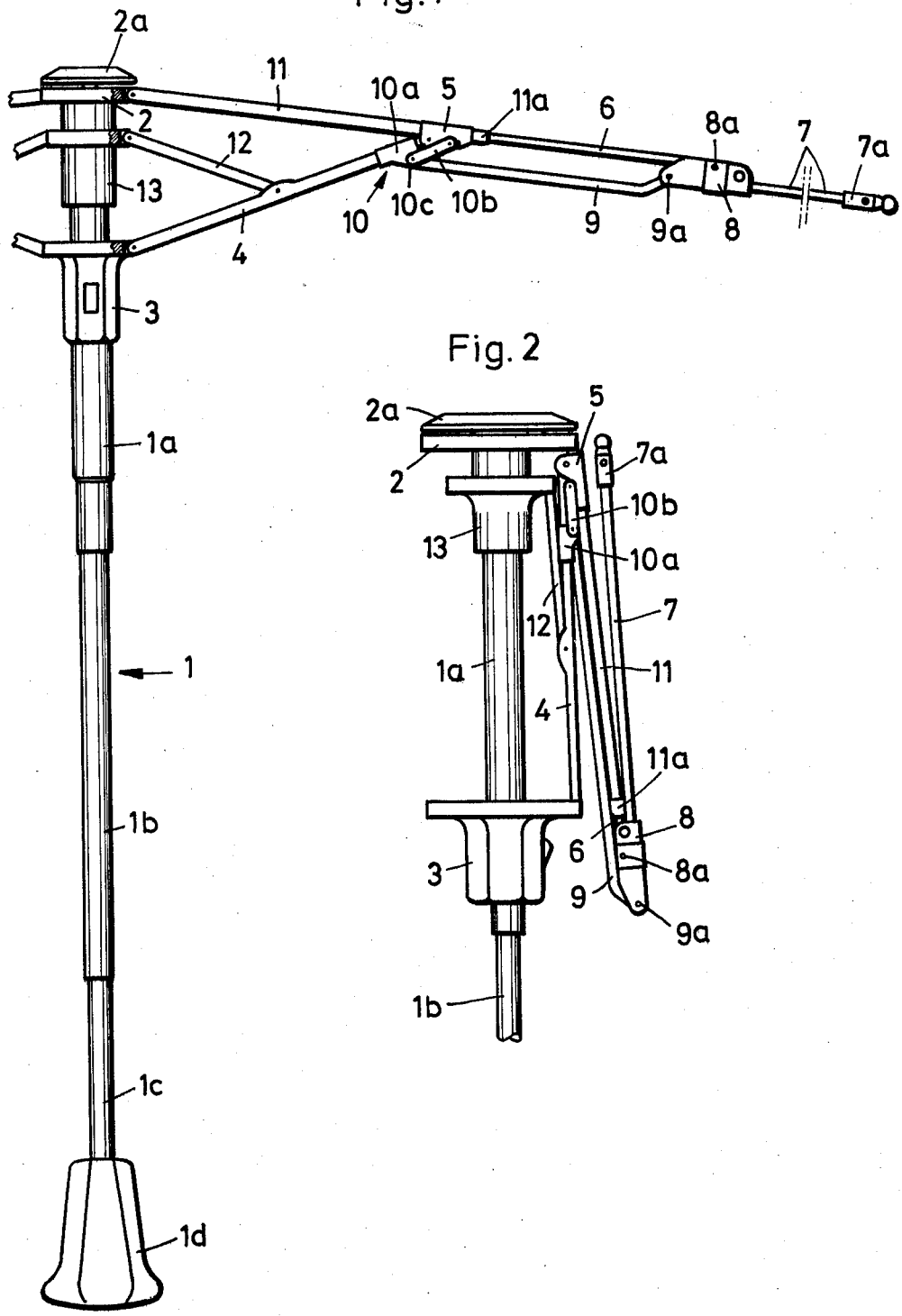

The invention relates to a shortenable umbrella with frame parts carrying the umbrella canopy in opened condition, the frame parts being shortenable at least by a factor of two by telescoping of folding, of which the innermost parts are pivoted on a crown secured on a shortenable rod assembly and are horizontally pivotable by means of at least one slider by means of at least one set of forks, whereby each outermost blade part is hinged foldable on the adjacent blade part by means of a control rod which acts on an extension of each outermost blade part.

Shortenable or contractable umbrellas of the previously mentioned type are known with telescopic canopy rod ribs or blades as well as with scissors-like joint folding or collapsible frame blades. With both designs the folded down blade parts have a tendency during the opening of the umbrella to fold back into the folded-up position, whereby the outer ring of the umbrella canopy is folded up. This is eliminated by the known embodiments by use of control rods, which engage respectively on an extension of the outermost foldable-down blade part and force a positive or constrained folding down movement of this outermost blade part during opening of the umbrella.

In order to adjust or correlate the course of movement produced by the control rods to the movement of the remaining frame parts, with the known embodiments it is necessary either to arrange resilient intermediate elements or to provide an elongated hole-connection between the outer-lying end of the control rod and the extension on the inner-lying end of the foldable blade part. While the design with an elongated hole connection has the disadvantage that the folding movement of the outermost blade parts are only imperfectly controlled, with the design having the resilient intermediate elements there exists the disadvantage that it is expensive in production as well as during assembly and beyond that it is particularly susceptible to trouble or failure to a marked degree.

In order to avoid these disadvantages and to effect a positive forceful constrained folding-down of the outermost blade parts without the use of resilient intermediate elements or to effect the elongated hole-connections compensating the control movement, it has already been proposed to pivotally fasten the inner end of the control rods respectively on a control piece formed as a slide hinge, which slide hinge is displaceably guided on the middle blade part and which is articulated on the fork by means of a connection rod. In this manner the advantage is obtained that, by means of fixed connections, an early folding-down of the outermost blade parts is achieved and the outermost umbrella cover ring is prevented from folding back.

The invention is based on the task to further develop this proposal in the manner of simplifying the construction and simplyfing the assembly, by which the use of a control piece which is displaceable on the middle blade part is to be avoided, since with certain umbrellas the danger exists that the umbrella cover becomes damaged by this control piece.

The solution of this object is characterized by the invention in the manner that the control piece is formed as a slide hinge which is displaceably guided on the fork, which slide hinge is articulated by means of a connection rod spaced from the articulation point of the fork on the middle hinge.

In this manner, the advantage is achieved that with the same manner of operation, a control piece which is displaceable on the middle blade part is avoided and that the control movement, which is produced by the movement of the fork, is not transmitted indirectly by means of a connection rod and a slide piece on the inner end of the control rod, but rather is transmitted directly, whereby detrimental influences to the course of movement are excluded. With the formation in accordance with the present invention, the connection rod which is arranged between the middle hinge and the slide hinge, the latter which is displaceably guided on the fork, serves to obtain a displacement movement of the slide hinge on the fork, by which the lever arm for the control movement which is exerted by the control rod is increased in the sense of an early folding-down of the outermost blade parts during the opening of the umbrella. By the choice of the effective length of the connection rod and the distance or spacing of its articulation point on the middle hinge from the articulation point of the fork on the middle hinge, in connection with the length of the control rod, not only can the control movement be given or preset during the folding-up and folding-down of the outermost blade part, but rather also the shape of the umbrella cover can be set with the stretched opened umbrella.

In order to achieve the most simple construction and assembly according to a further feature of the invention, the connection rod and the inner end of the control rod are articulated jointly by means of a rivet on the slide hinge.

A further simplification is produced with the invention in the manner that the slide hinge and the connection rod are formed integrally as one control piece, the latter being articulated on the middle hinge and displaceable on the fork, so that instead of a connection rod and a slide hinge only one control piece is to be produced and assembled.

With a preferred embodiment of the invention, the control piece is formed in cross-section U-shaped with forked ends, by which one of the ends is articulated on the middle hinge by means of a pivot rivet and the other end grips the fork from behind by means of a guide rivet, on which guide rivet the inner end of the control rod is articulated. Besides a constructive and assembling-wise simplification by this further development, the frictional forces for guiding of the control piece on the fork are considerably reduced.

Figure 3:
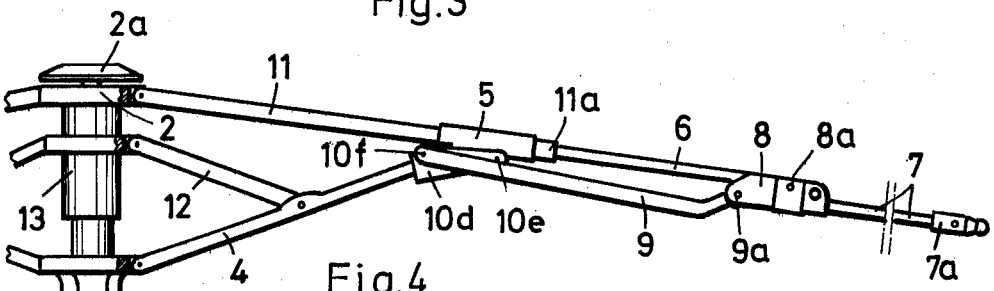
Figure 4:
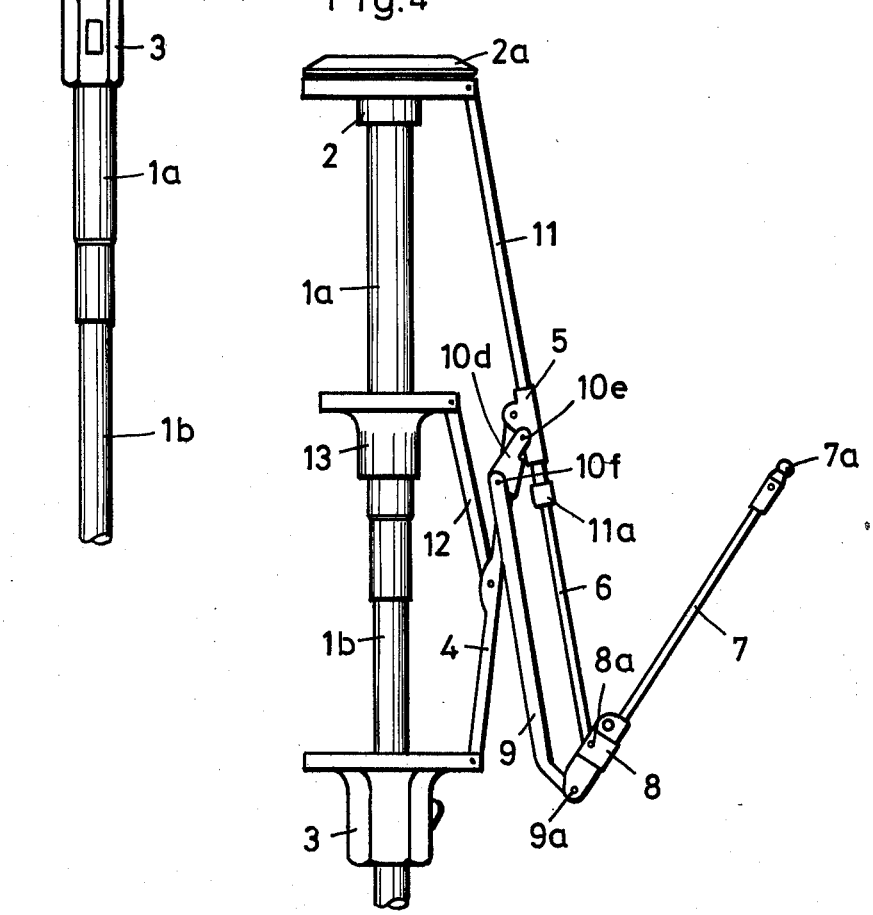
Figure 5:
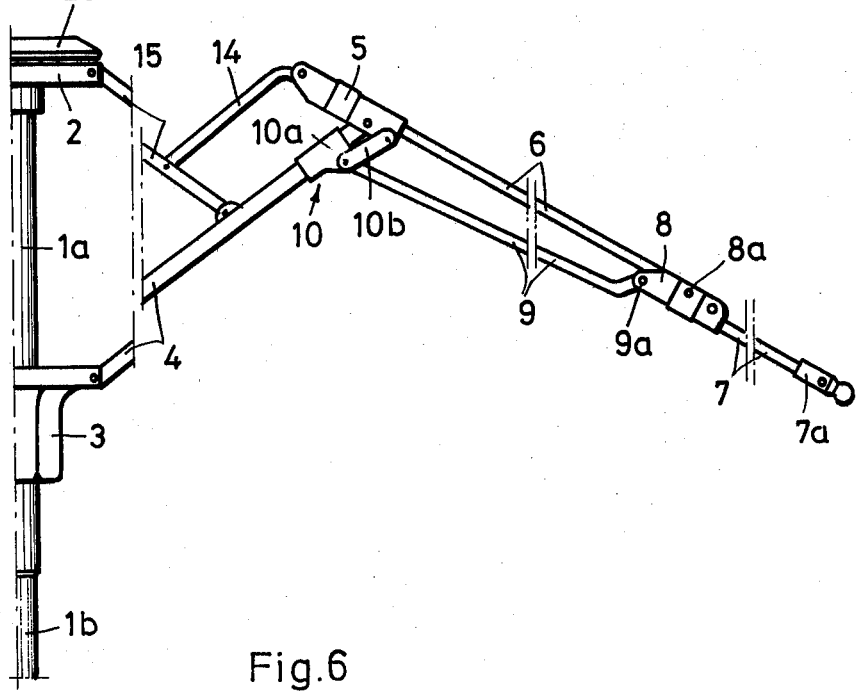
Figure 6:
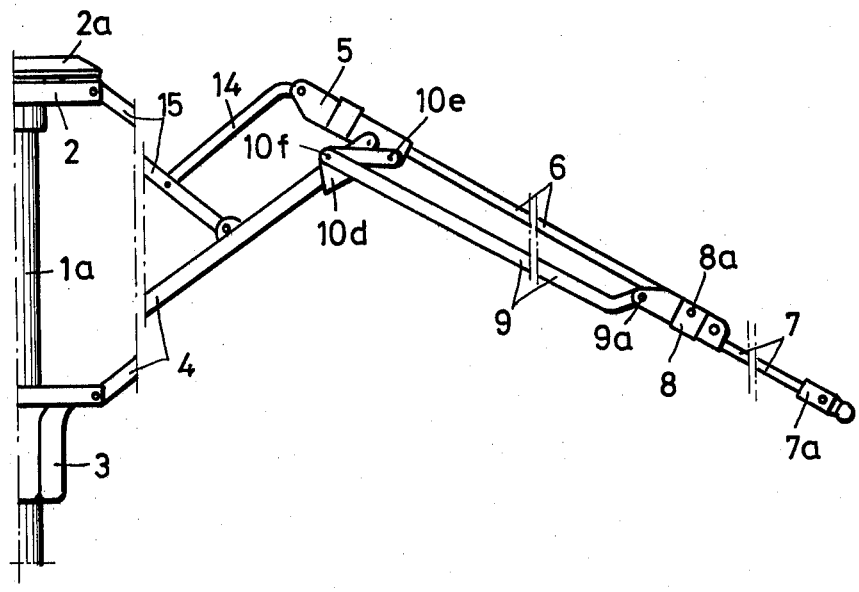

Four embodiments of an umbrella in accordance with the invention are illustrated on the drawing, and indeed show:

FIG. 1 a first embodiment of a telescopic umbrella in opened-up condition,

FIG. 2 the umbrella illustrated in FIG. 1 in the collapsed condition,

FIG. 3 a second embodiment of a telescopic umbrella in the opened-up condition, FIG. 4 the umbrella of FIG. 3 in half-opened condition, FIG. 5 a third embodiment in the shape of a scissors-joint umbrella, and FIG. 6 a further scissors-joint umbrella with a modified construction of the control piece.

The first embodiment illustrated in FIGS. 1 and 2 has a three part rod assembly 1 which comprises an outer tube 1*a*, a center tube 1*b*, and an inner tube 1*c*, which are telescopically guided within each other. A handle 1*d* is secured at the free end of the inner tube 1*c* and a crown 2 is secured at the free end of the outer tube 1*a*. An umbrella cover which is not illustrated in the drawing is fixed on the crown 2 by means of a cap or top 2*a*.

A slider 3 is moveably arranged on the outer tube 1*a l* of the rod assembly 1. A plurality of forks 4 are articulated to the slider 3. Only one fork 4 is completely illustrated in the drawings for the sake of an improved overall view.

The outer end of each fork 4 is articulated on a middle hinge 5, the latter being fastened on the inner-lying end of a middle blade part 6. A folding hinge 8 is articulated by means of a folding pin 8*a* on the outer end of this blade part 6, the folding hinge 8 being secured on the inner-lying end of an outermost blade part 7. The outermost blade part 7 is arranged so as to be foldable on the middle blade part 6 with the aid of the folding hinge 8, whereby the folding movement is controllable by means of a control rod 9 which is articulated by means of a pivot or hinge pin 9*a* on that part of the folding hinge 8 which is inwardly extended across or over the folding pin 8*a*. Each outermost blade part 7 is provided with a pole or blade top end cap 7*a*, which has a hole likewise as the hinges 5 and 8 so that the umbrella cover can be sewed or tied-on to these parts or can be otherwise fastened.

The shortenable umbrella according to FIGS. 1 and 2 is constructed as a telescopic umbrella and has an innermost blade part 11 into which the middle blade part 6 telescopically can be pushed. This innermost blade part 11 is pivotably articulated with its inner-lying end on the crown 2. The blade part 11 on the outermost-lying end carries a small band 11*a* on which the middle hinge 5 (which is fastened to the middle blade part 6) comes into contact or engagement with an opened umbrella, as illustrated in FIG. 1. Finally the umbrella according to FIGS 1 and 2 has auxiliary forks 12 which are articulated on the forks 4, the auxiliary forks 12 being pivotable by means of an auxiliary slider 13.

A control piece 10 cooperates with each fork 4, which according to the embodiment of FIGS. 1 and 2, comprises a slide hinge 10*a* and a connection rod 10*b*. The slide hinge 10*a* is displaceably guided on the fork 4. The displacement movement is controlled by the connection rod 10*b* which is articulated on the middle hinge 5, whereby the articulation point of the connection rod 10*b* lies spaced from the articulation point of the fork 4. The connection rod 10*b* and the inner end of the control rod 9 are articulated jointly or in common on the slide hinge 10*a* by means of a rivet 10*c*.

During the opening of the pocket umbrella illustrated in FIGS. 1 and 2 from the collapsed of folded position according to FIG. 2, after pulling the three part rod assembly 1 out from one another, the slider 3 moves in the direction toward the handle 1*d*. In this manner the middle blade part 6 is telescopically pulled out from the innermost blade part 11 and both parts are horizontally pivoted by means of the associated fork 4; this pivot movement is supported or assisted by the auxiliary forks 12 which are pivoted on the auxiliary slider 13.

At the beginning of the horizontal pivotal movement of the forks 4, the control rod is actuated so that the outermost blade part 7 is folded down about the folding pin 8*a* out from the parallel position folded-up on the middle blade part 6. This folding down movement is carried out itensified or in an increased manner since the lever arm of the control rod 9 at the beginning of the opening movement of the umbrella is the greatest. This results in the manner that the slide hinge 10*a* is located at its largest distance away from the articulation point of the fork 4 on the middle hinge 5. With increasing pivotal movement, the slide hinge 10*a* approaches the middle hinge 5, so that in this manner the lever arm and consequently simultaneously the folding-down movement are reduced or diminished. With the fully opened umbrella, the slide hinge 10*a* nearly engages against or contacts the middle hinge 5. The control rod 9 is substantially parallel to the middle blade part 6, and the outermost blade part 7 is located in the completely folded down position.

By a suitable selection of the dimensions of the connection rod 10*b*, the control rod 9 and the articulation points of the fork 4 as well of the connection rod 10*b* on the middle hinge 5, in this completely opened position of the umbrella, an outwardly directed arching or curving of the middle blade part 6 can be achieved, as this is frequently desired for formation of arched umbrella canopies and for attaining a larger stability of the umbrella canopy.

During the closing of the umbrella from the opened position according to FIG. 1, automatically a folding-up of the outermost blade part 7 on the middle blade part 6 occurs. The course of movement of the individual parts takes place in reverse sequence to that which has been previously described.

The embodiment illustrated in FIGS. 3 and 4 furthermore shows a telescopic flat umbrella. This embodiment differs from that according to FIGS. 1 and 2 merely by another formation of the control piece which is executed as one piece or integrally.

The control piece 10*d* of the second embodiment is formed U-shaped in cross-section with forked ends. One of the ends of the control piece 10*d* is articulated by means of a pivot rivet 10*e* on the middle hinge 5. The other forked end grips or engages the fork 4 therebehind by means of a guide rivet 10*f*, on which guide rivet simultaneously together the inner end of the control rod 9 is articulated. The guiding of the control piece 10*d* on the fork 4 takes place consequently by the stay or web of the altogether or completely U-shaped control piece 10*d*, particularly yet by means of the guide rivet 10*f*. The hereby occurring friction forces are considerably smaller than that with the embodiment according to FIGS. 1 and 2, since not only are the guide surfaces considerably smaller, but rather as a result of the previously described formation, a larger play exists. The course of movement corresponds yet completely with the course of movement which has been described above with respect to the first embodiment.

The use of the above-described control pieces 10 and 10*d*, respectively, is not limited to telescopical pocket umbrellas. FIGS. 5 and 6 show a so-called scissors-joint umbrella by which the middle hinge 5 is not displaceably guided on an innermost blade part 11, but rather is articulated on a stretch fork 14 which in turn is pivotally fastened with its free end on a scissors-jointed fork 15 which extends between the crown 2 and the associated fork 4. The formation of the control piece 10 according to FIG. 5 corresponds to the formation of the embodiment according to FIGS. 1 and 2. The control piece 10*d* of the scissors-joint umbrella according to FIG. 6 corresponds to the formation according to FIGS. 3 and 4. In both cases, no deviation occurs with respect to the course of movement and of the folding movement for the outermost blade part in comparison to the previously described embodiments.

We claim:

1. A shortenable umbrella having frame parts including blades carrying the umbrella canopy in opened condition, the blades being shortenable at least by a factor of two by telescoping or folding, and having a shortenable rod assembly and a crown secured on the shortenable rod assembly and at least one set of forks operatively connected by means of at least one slider, the latter displaceably disposed on the shortenable rod assembly, for pivoting the blades, comprising an innermost blade part being pivoted on the crown, an outermost blade part having an extension, a middle blade part operatively connected to said innermost and outermost blade parts, respectively, a fork operatively connected to the slider, a middle hinge operatively pivotally connecting said middle blade part and said fork at an articulation point of said fork, a control rod operatively connected to said extension of said outermost blade part, said outermost blade part being hinged foldably onto said middle blade part and actuatable therefor by means of said control rod, said control rod having an inner end, a control piece constituting a slide hinge being pivotally articulated to said inner end of said control rod, said slide hinge being displaceably disposed on said fork, said slide hinge including a connection means for articulating said slide hinge onto said middle hinge spaced from said articulation point of said fork, said control piece being actuated by movement of said fork.

2. The shortenable umbrella as set forth in claim 1, further comprising a rivet means for jointly articulating said connection means and said inner end of said control rod on said slide hinge, said connection means comprising a connection rod.

3. The shortenable umbrella as set forth in claim 1, wherein said connection means comprises a connection rod articulated on said slide hinge at a first pivot point and on said middle hinge at a second pivot point, the latter being spaced from said articulation point of said fork on said middle hinge.

4. The shortenable umbrella as set forth in claim 1, wherein said slide hinge and said connection means are formed integrally as said control piece, the latter being articulated on said middle hinge and displaceable on said fork.

5. The shortenable umbrella as set forth in claim 4, wherein said control piece is U-shaped in cross-section having forked ends, pivot rivet means for articulating one of said ends on said middle hinge, guide rivet means for gripping the other of said ends in back of said fork, said inner end of said control rod is articulated on said guide rivet means.

* * * * *